US011274854B2

(12) United States Patent
Kim

(10) Patent No.: US 11,274,854 B2
(45) Date of Patent: Mar. 15, 2022

(54) ELECTRODE BOILER CONTROL APPARATUS HAVING INTAKE AND EXHAUST CONTROL VALVE AND ELECTRONIC VALVE, AND ELECTRODE BOILER CONTROL METHOD USING SAME

(71) Applicant: Inho Kim, Gwangyang-si (KR)

(72) Inventor: Inho Kim, Gwangyang-si (KR)

( * ) Notice: Subject to any disclaimer, the term of this patent is extended or adjusted under 35 U.S.C. 154(b) by 759 days.

(21) Appl. No.: 16/305,050

(22) PCT Filed: May 12, 2017

(86) PCT No.: PCT/KR2017/004938
§ 371 (c)(1),
(2) Date: Nov. 27, 2018

(87) PCT Pub. No.: WO2017/209408
PCT Pub. Date: Dec. 7, 2017

(65) Prior Publication Data

US 2020/0318860 A1 Oct. 8, 2020

(30) Foreign Application Priority Data

May 31, 2016 (KR) ..... 10-2016-0067024

(51) Int. Cl.
*F24H 9/20* (2006.01)
*F24H 1/22* (2006.01)

(52) U.S. Cl.
CPC ..... *F24H 9/2007* (2013.01); *F24H 1/22* (2013.01); *F24H 2250/10* (2013.01)

(58) Field of Classification Search
CPC ..... F24H 2250/10; F24H 1/22; F24H 1/225; F24H 9/20; F24H 9/2007; F24H 9/2014; F24H 7/0208
See application file for complete search history.

(56) References Cited

U.S. PATENT DOCUMENTS 3,824,372 A * 7/1974 Eaton ..... F24H 1/225 392/326
4,052,587 A * 10/1977 Eaton ..... F22B 1/303 392/326

(Continued)

FOREIGN PATENT DOCUMENTS

JP 3171541 U 11/2011
KR 10-1016256 B1 2/2011

(Continued)

OTHER PUBLICATIONS

International Search Report for PCT/KR2017/004938 dated Aug. 17, 2017 from Korean Intellectual Property Office.

*Primary Examiner* — Steven S Anderson, II
(74) *Attorney, Agent, or Firm* — Revolution IP, PLLC

(57) ABSTRACT

An electrode boiler control apparatus includes a control circuit formed in an electrode boiler in which an intake electronic valve and an exhaust electronic valve in addition to an intake control valve and an exhaust control valve corresponding to air control valves formed at both sides of an upper portion of the electrode boiler, connected to the intake electronic valve and the exhaust electronic valve to control the intake electronic valve and the exhaust electronic valve; a current controller connected to a current transformer connected between electrode bars of the electrode boiler to control the current transformer; and a temperature controller connected to a temperature sensor formed on a hot water tank of the electrode boiler, and configured to control the temperature sensor and receive a temperature value measured by the temperature sensor.

1 Claim, 5 Drawing Sheets

(56) References Cited

U.S. PATENT DOCUMENTS

| | | | | | |
|---|---|---|---|---|---|
| 4,196,341 | A * | 4/1980 | Williams | F22B 1/30 | 392/325 |
| 4,935,601 | A * | 6/1990 | Eaton-Williams | F22B 1/30 | 392/464 |
| 4,952,779 | A * | 8/1990 | Eaton-Williams | F22B 1/30 | 392/322 |
| 2003/0155938 | A1 * | 8/2003 | Sanders | G01F 23/244 | 324/715 |

FOREIGN PATENT DOCUMENTS

| | | | |
|---|---|---|---|
| KR | 10-2011-0097465 | A | 8/2011 |
| KR | 10-2011-0135172 | A | 12/2011 |
| KR | 10-1570804 | B1 | 11/2015 |

* cited by examiner

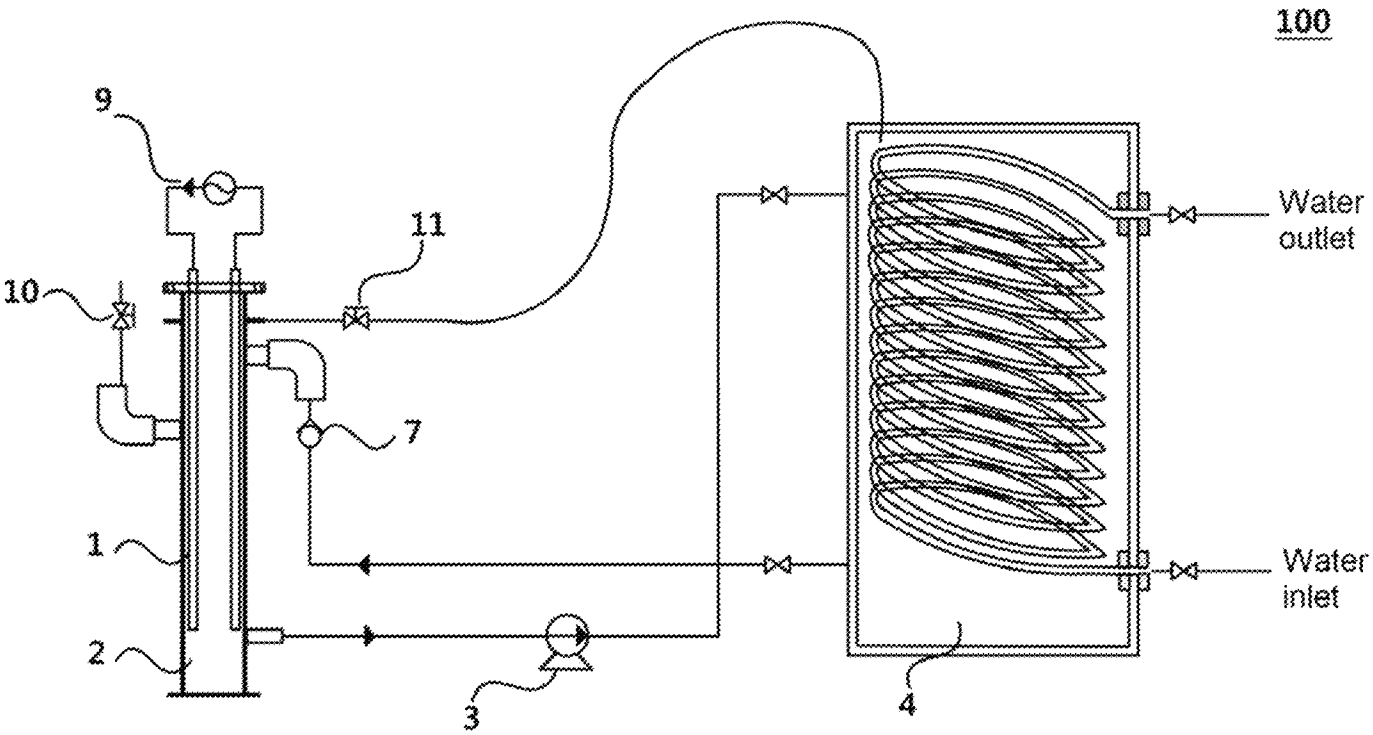
[FIG. 1]

[FIG. 2]
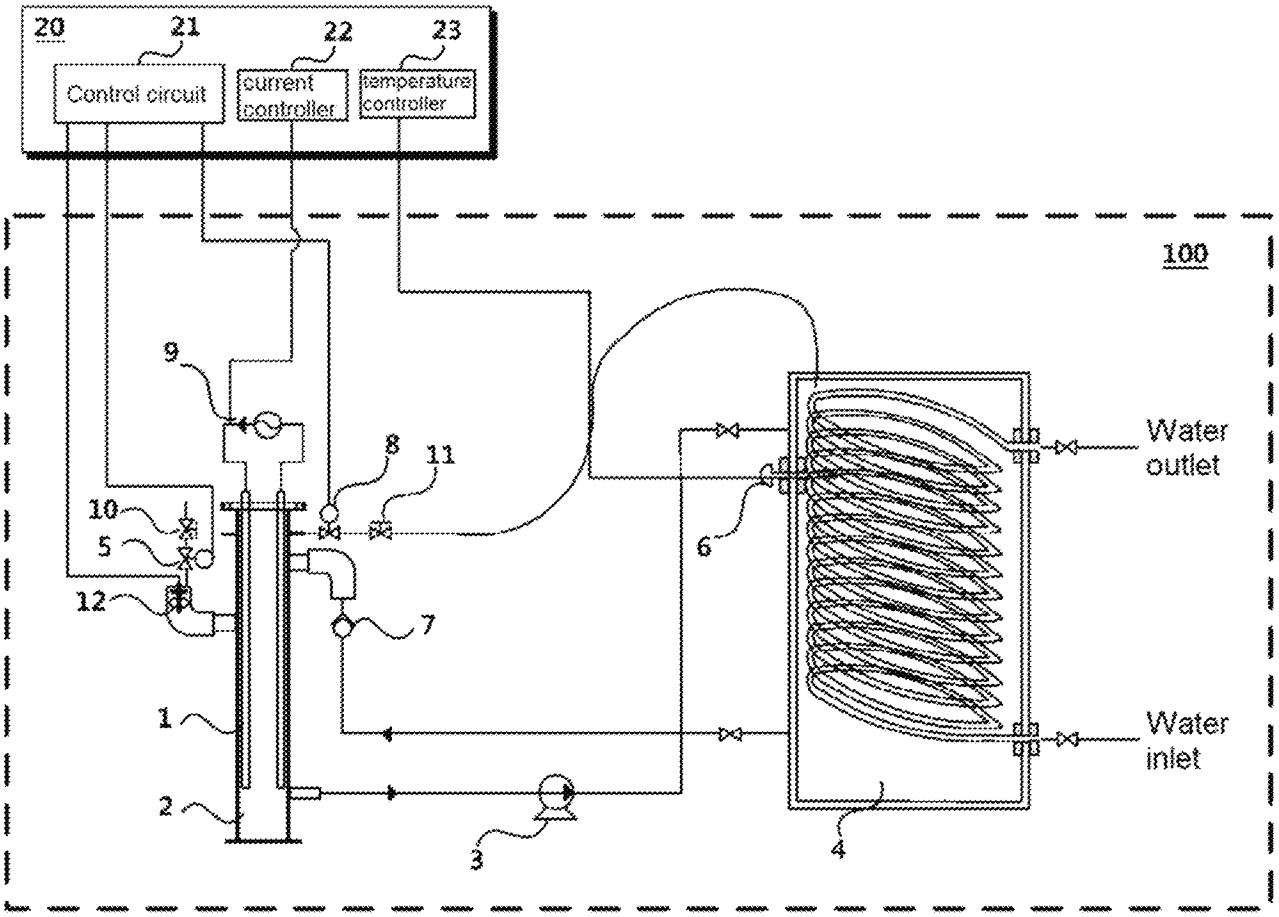

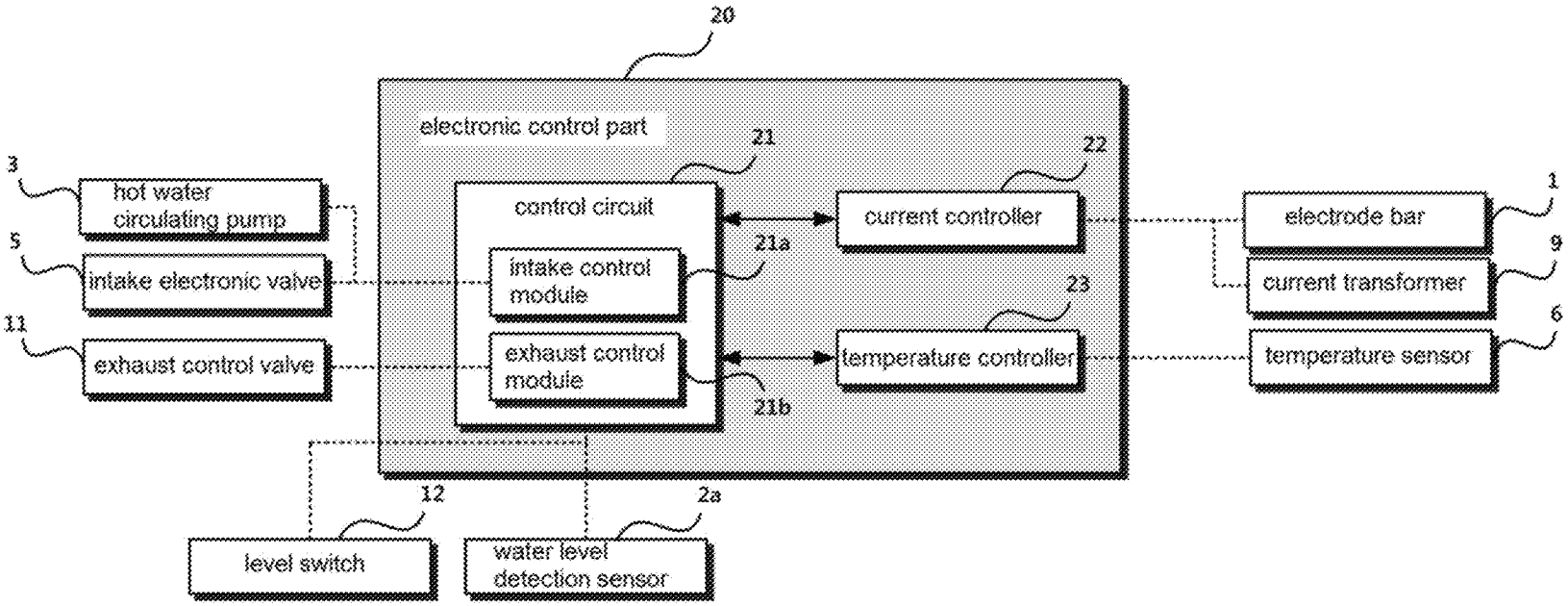
[FIG. 3]

[FIG. 4]
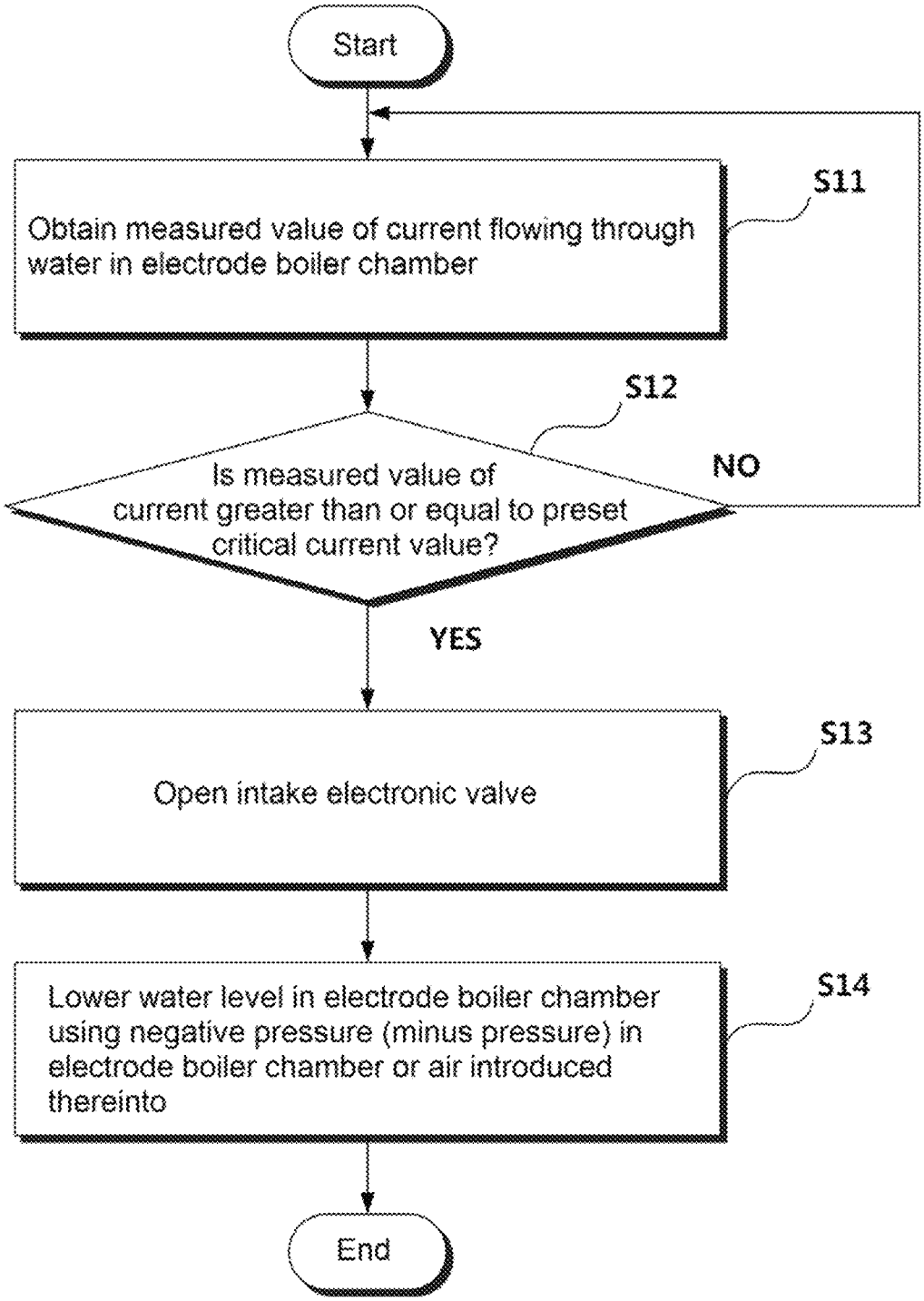

[FIG. 5]
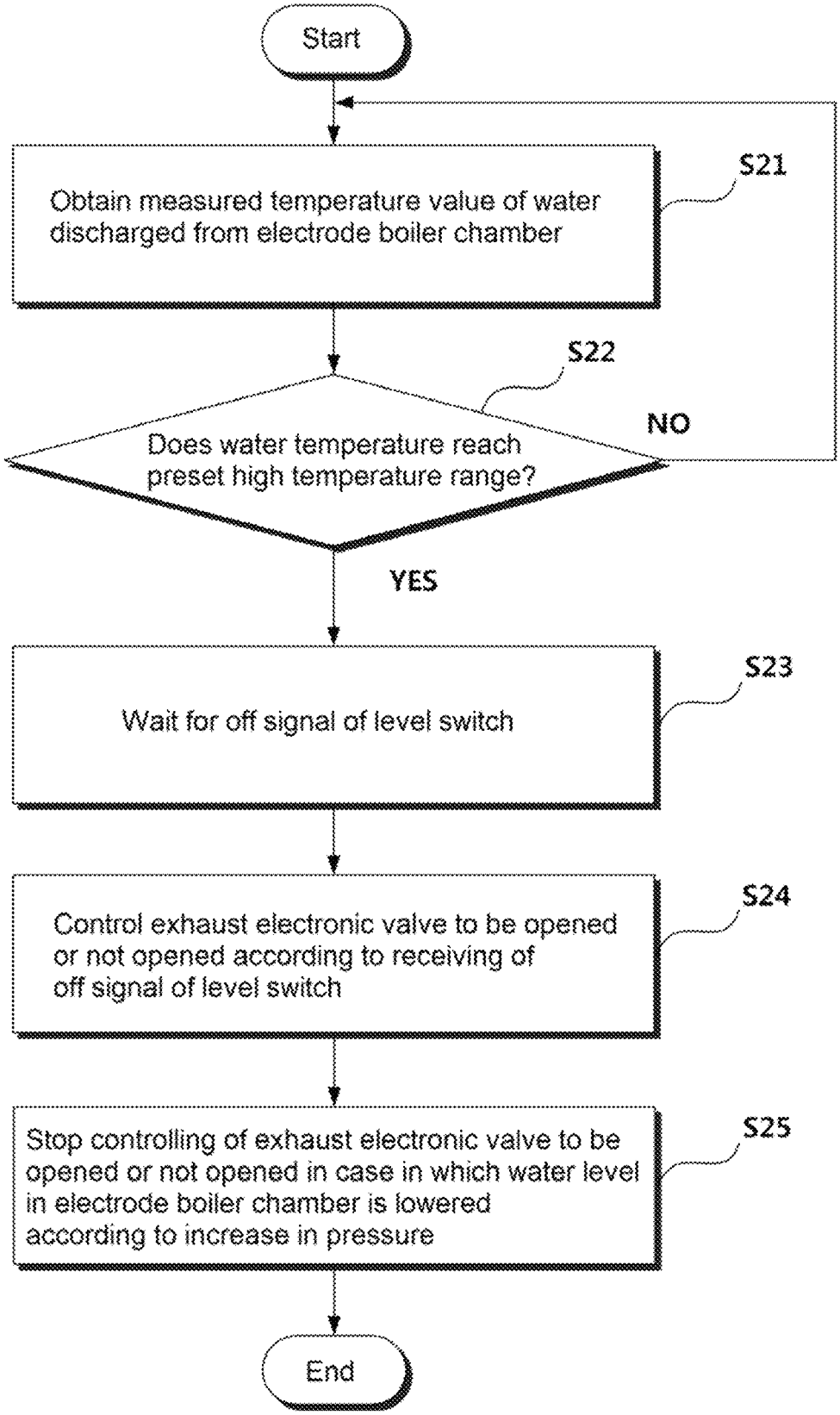

ELECTRODE BOILER CONTROL APPARATUS HAVING INTAKE AND EXHAUST CONTROL VALVE AND ELECTRONIC VALVE, AND ELECTRODE BOILER CONTROL METHOD USING SAME

TECHNICAL FIELD

The present invention relates to an electrode boiler control apparatus including intake and exhaust control valves and an electronic valve, and an electrode boiler control method using the same, and more specifically, to an electrode boiler control apparatus including intake and exhaust control valves and an electronic valve to solve a problem of power supply stopping due to an overload on a power supply line, which is caused by a rapid increase in a current flowing through water in an electrode boiler, and an electrode boiler control method using the same.

BACKGROUND ART

An electrode boiler is a boiler operated through a method of applying current to a plurality of electrode bars arranged in an electrode boiler chamber to heat a heating medium stored in the electrode boiler chamber, and the method includes a method of generating an arc at in electrolyte solution, which has a high concentration and is used as a heating medium, between electrode bars to heat the heating medium, or a method of heating water in which a small amount of electrolyte solution is diluted instead of generating an arc.

DISCLOSURE

Technical Problem

The present invention is directed to providing an electrode boiler control apparatus including intake and exhaust control valves and an electronic valve to prevent power supply from being stopped due to an overload on a power supply line, which occurs due to a rapid increase in a current flowing through water in an electrode boiler, and an electrode boiler control method using the same.

Technical Solution

One aspect of the present invention provides an electrode boiler control apparatus including intake and exhaust control valves and an electronic valve which comprises an electronic control part (20) formed in an electrode boiler (100) in which an intake electronic valve (5) and an exhaust electronic valve (8) in addition to an intake control valve (10) and an exhaust control valve (11) corresponding to air control valves are formed at both sides of an upper portion of the electrode boiler (100) and including a control circuit (21) connected to the intake electronic valve (5) and the exhaust electronic valve (8) to control the intake electronic valve (5) and the exhaust electronic valve (8), a current controller (22) connected to a current transformer (CT, 9) connected between electrode bars (1) of the electrode boiler (100) to control the CT (9), and a temperature controller (23) connected to a temperature sensor (6) formed on a hot water tank (4) of the electrode boiler (100), and configured to control the temperature sensor (6) and receive a temperature value measured by the temperature sensor (6), wherein the control circuit (21) includes an intake control module (21*a*) configured to control such that, in a case in which a measured value of a current measured by the current transformer (9) and received through the current controller (22) is greater than or equal to a preset critical current value, a relay contact signal is transmitted to open the intake electronic valve (5), and when a negative pressure (minus pressure) in the electrode boiler chamber (2), which is generated by a hot water circulating pump (3) of the electrode boiler (100) is used or compressed air which is externally supplied is introduced into the electrode boiler chamber (2), a water level in the electrode boiler chamber (2) is lowered due to the negative pressure (minus pressure) or the introduced air to decrease a contact area of water in contact with the electrode bars (1) of the electrode boiler (100) so that a current value returns to a normal range.

Here, the control circuit (21) may further includes an exhaust control module (21*b*) configured to control such that, since a case in which a water temperature measured by the temperature sensor (6) connected to the temperature controller (23) is within a preset high temperature range corresponds to a case in which a current flows through water so that the water is boiled, it is determined that a pressure in the electrode boiler chamber (2) increases to lower the water level, an OFF signal of the level switch (12), which is a level sensor installed at the side of the external air pipe of a column of the electrode boiler chamber (2), is received thereby, the exhaust electronic valve (8) is controlled to open to discharge steam, a pressure in the electrode boiler chamber (2) decreases, and a water level increases so that the current within a normal range, within which the water temperature in the electrode boiler chamber (2) does not reach the preset high temperature range, flows through the water.

Another aspect of the present invention provides a method of controlling an electrode boiler including intake and exhaust control valves and an electronic valve, the method includes a first operation in which the electronic control part (20) obtains a measured value of a current flowing through water in the electrode boiler chamber (2); a second operation in which the electronic control part (20) determines whether the measured value of the current is greater than or equal to a preset critical current value; a third operation in which, in a case in which the measured value of the current is greater than or equal to the preset critical current value, the electronic control part (20) opens the intake electronic valve (5); and a fourth operation in which the electronic control part (20) controls such that a water level in the electrode boiler chamber (2) is lowered due to a negative pressure (minus pressure) in the electrode boiler chamber (2) or the introduced air thereinto.

In addition, in the fourth operation, until the measured value of the current becomes less than the preset critical current value, the electronic control part (20) controls such that the negative pressure (minus pressure) in the electrode boiler chamber (2), which is generated by the hot water circulating pump (3) of the electrode boiler (100), is used or compressed air which is externally supplied is introduced into electrode boiler chamber (2) by controlling the intake control valve (10) to lower the water level in the electrode boiler chamber (2) using the negative pressure (minus pressure) or the introduced air so that a contact area of the water in contact with the electrode bar (1) decreases, a current value returns to a normal range, and the electrode boiler (100) performs a function normally.

Still another aspect of the present invention provides a method of controlling an electrode boiler including intake and exhaust control valves and an electronic valve, the method includes a first operation in which the electronic control part (20) obtains a measured value of water discharged from the electrode boiler chamber (1); a second operation in which the electronic control part (20) determines whether the obtained temperature of the water reaches a preset high temperature range; a third operation in which, in a case in which the obtained temperature of the water reaches the preset high temperature range, the electronic control part (20) waits for an OFF signal from the level switch (12); and a fourth operation in which the electronic control part (20) controls the exhaust electronic valve (8) to be opened or not opened according to receiving of the OFF signal from the level switch.

Here, the method may further include a fifth operation in which, in a case in which the water level in the electrode boiler chamber (2) is lowered by as much as an increase in a pressure, the electronic control part (20) stops controlling of the exhaust electronic valve (8) to be opened or not opened after the fourth operation.

Advantageous Effects

According to the present invention, a method of decreasing an area in contact with an electrode bar by controlling a water level to be lowered in an electrode boiler chamber in order to solve a problem of power supply stopping due to an overload on a power supply line, which is caused by a rapid increase in current flowing through water in an electrode boiler, is proposed.

In addition, a method of decreasing a pressure in an electrode boiler chamber to allow a current within a normal range to flow through water in an electrode boiler chamber is proposed as another method for solving a problem of power supply stopping due to an overload on a power supply line.

DESCRIPTION OF DRAWINGS

FIG. 1 is a view illustrating a configuration of an electrode boiler in which an electrode boiler control apparatus including intake and exhaust control valves and an electronic valve according to an embodiment of the present invention is not installed.

FIG. 2 is a view illustrating a structure in which the electrode boiler control apparatus including intake and exhaust control valves and an electronic valve is installed in the electrode boiler of FIG. 1.

FIG. 3 is a block diagram specifically illustrating a configuration of the electrode boiler control apparatus including intake and exhaust control valves and an electronic valve of FIG. 2.

FIG. 4 is a flowchart illustrating a method of controlling an electrode boiler including intake and exhaust control valves and an electronic valve according to a first embodiment of the present invention.

FIG. 5 is a flowchart illustrating a method of controlling an electrode boiler including intake and exhaust control valves and an electronic valve according to a second embodiment of the present invention.

REFERENCE NUMERALS

1: ELECTRODE BAR
2: ELECTRODE BOILER CHAMBER
2*a*: WATER LEVEL DETECTION SENSOR
3: HOT WATER CIRCULATING PUMP
4: HOT WATER TANK
5: INTAKE ELECTRONIC VALVE
6: TEMPERATURE SENSOR
7: CHECK VALVE
8: EXHAUST ELECTRONIC VALVE
9: CURRENT TRANSFORMER (CT)
10: INTAKE CONTROL VALVE
11: EXHAUST CONTROL VALVE
12: LEVEL SWITCH
20: ELECTRONIC CONTROL PART
21: CONTROL CIRCUIT
21*a*: INTAKE CONTROL MODULE
21*b*: EXHAUST CONTROL MODULE
22: CURRENT CONTROLLER
23: TEMPERATURE CONTROLLER
100: ELECTRODE BOILER

MODES OF THE INVENTION

Hereinafter, an electrode boiler control apparatus including intake and exhaust control valves and an electronic valve, and an electrode boiler control method using the same will be described with reference to the accompanying drawings.

FIG. 1 is a view illustrating a configuration of an electrode boiler 100 in which the electrode boiler control apparatus (hereinafter, referred to as an electronic control part 20) including intake and exhaust control valves and an electronic valve according to an embodiment of the present invention is not installed. FIG. 2 is a view illustrating a structure in which the electronic control part 20 is installed in the electrode boiler 100. FIG. 3 is a block diagram specifically illustrating a configuration of the electronic control part 20 of FIG. 2.

First, referring to FIG. 1, the electrode boiler 100 in which the electronic control part 20 is formed includes electrode bars 1, an electrode boiler chamber 2, a hot water circulating pump 3, a hot water tank 4, a check valve 7, a current transformer (CT) 9, an intake control valve 10, an exhaust control valve 11, and a level switch 12.

The electrode bars 1 are formed in bar shapes facing each other in the electrode boiler chamber 2 in which water is stored, a pair of the electrode bars 1 are disposed in the case of two-phase power, and the electrode bars 1 are disposed in a regular triangle of R, S, and T in the case of three-phase power. The present invention will be described with an example in which the pair of the electrode bars 1 are disposed.

The hot water circulating pump 3 is interposed between a water outlet end formed at a lower portion of the electrode boiler chamber 2 and a water inlet side formed at an upper portion of the hot water tank 4 and circulates hot water generated in the electrode boiler chamber 2 to the hot water tank 4.

The hot water tank 4 uses heat of the hot water transmitted from the electrode boiler chamber 2 using a separate heat exchanger.

The check valve 7 is formed between a water outlet side of the hot water tank 4 and a water inlet side of the electrode boiler chamber 2 to prevent water supplied to the electrode boiler chamber 2 from the hot water tank 4 from flowing backward toward the hot water tank 4.

The intake control valve 10 is formed at a side of an external air pipe in which the level switch 12 is formed and formed as a valve through which external air is introduced into the electrode boiler chamber 2, and an intake electronic valve 5, which will be described below, is connected to a front end of the control valve 10 in series. When the intake electronic valve 5 is opened, the intake control valve 10 discharges a steam pressure generated due to heating of water in the electrode boiler chamber 2.

The exhaust control valve 11 is formed at a side of an external air pipe which is disposed at one side of an upper portion of the electrode boiler chamber 2 and is in communication with the hot water tank 4, and an exhaust electronic valve 8, which will be described below, is connected to a front end of the exhaust control valve 11 in series. When the exhaust electronic valve 5 is opened, the exhaust control valve 11 discharges the steam pressure to the hot water tank 4.

Next, referring to FIG. 2, the electronic control part 20 formed in the electrode boiler 100 of FIG. 1 includes a control circuit 21, a current controller 22, and a temperature controller 23 and is connected to a temperature sensor 6, the intake electronic valve 5, and the exhaust electronic valve 8.

Here, the temperature sensor 6 is formed at a side portion of the hot water tank 4 in order to measure a temperature of water in the hot water tank 4 and is connected to the temperature controller 23 of the electronic control part 20.

More specifically, the temperature sensor 6 is formed below and adjacent to the water inlet side of the hot water tank 4 to measure a temperature of hot water which is transmitted to the hot water tank 4 from the electrode boiler chamber 2 and transmit a measured value of the temperature to the temperature controller 23.

Meanwhile, in the electrode boiler 100 having the structure illustrated in FIGS. 1 and 2, a current directly flows through water containing an electrolyte in the electrode boiler chamber 2 according to an amount of current controlled by the current controller 22.

Here, since the water is heated and boiled due to Joule heating ($Q=I^2R$) generated in the electrode boiler chamber 2 and an electric conductivity of the water is sensitively changed according to an electrolyte concentration in the water and a change in a temperature of the water due to a current flowing through the water in the electrode boiler chamber 2, very precise control is required.

In other words, in a case in which the water in the electrode boiler chamber 2 is boiled, within a first temperature value range corresponding to a relatively low temperature, a current within an $a^{th}$ current value range corresponding to a relatively low current flows through the water according to control of the current controller 22, and within a second temperature value range (a minimum value within the second temperature value range is greater than a maximum value within the first temperature value range) corresponding to a relatively high temperature, a current within a $b^{th}$ current value range (a minimum value within the $b^{th}$ current value range is greater than a maximum value within the $a^{th}$ current value range) corresponding to a relatively high current flows through the water.

Meanwhile, since a temperature of the water in the electrode boiler chamber 2 rapidly increases within the $b^{th}$ current value range, and an increasing speed of the water temperature is also fast, there is a problem in that an overload occurs on a power supply line to trip a circuit breaker (not shown), which stops power supply, the water is suddenly boiled so that the electrode boiler chamber 2 is filled with steam and a current no longer flows, or the current very unstably flows so that the electrode boiler 100 may not perform a function normally.

In order to solve such a problem, the present invention provides the electronic control part 20 including the control circuit 21, the current controller 22, and the temperature controller 23 as illustrated in FIG. 2. Referring to FIG. 3, the control circuit 21 is divided into an intake control module 21*a* and an exhaust control module 21*b*. In addition, a water level detection sensor 2*a* is formed in the electrode boiler chamber 2, and the water level detection sensor 2*a* may measure a water level in the electrode boiler chamber 2 and transmit the measured water level to the control circuit 21 in real time.

In addition, the control circuit 21 is connected to the intake electronic valve 5, the exhaust electronic valve 8, and the level switch 12 to perform control. The current controller 22 is connected to the CT 9 connected between the electrode bars 1. The temperature controller 23 is connected to the temperature sensor 6 formed on the hot water tank 4 to control the temperature sensor 6 and receive a temperature value measured by the temperature sensor 6.

Meanwhile, the intake electronic valve 5 and the exhaust electronic valve 8 in addition to the intake control valve 10 and the exhaust control valve 11 corresponding to air control valves are installed at both sides of an upper portion of the electrode boiler 100, and the intake electronic valve 5 and the exhaust electronic valve 8 are connected to and controlled by the control circuit 21.

That is, the current controller 22 receives a measured value of a current flowing through water flowing in the electrode boiler chamber 2 from the CT 9 and transmits the measured value to the control circuit 21.

Accordingly, in a case in which the received measured current value is greater than or equal to a predetermined critical current value, the intake control module 21*a* of the control circuit 21 transmits a relay contact signal to open the intake electronic valve 5, and when a negative pressure (minus pressure) in the electrode boiler chamber 2, which is generated by the hot water circulating pump 3, is used, or compressed air, which is externally supplied, is introduced into the electrode boiler chamber 2, a water level in the electrode boiler chamber 2 is lowered due to the negative pressure (minus pressure) or the introduced air to decrease a contact area of water in contact with the electrode bars 1 and allow the current value to return to a normal range, and thus the electrode boiler 100 performs a function normally.

In addition, since a case in which a water temperature measured by the temperature sensor 6 connected to the temperature controller 23 is within a preset high temperature range (for example, 100° C.±a) corresponds to a case in which a high current flows through water so that the water is boiled, a pressure in the electrode boiler chamber 2 increases so that a water level is lowered. Accordingly, the exhaust control module 21*b* of the control circuit 21 receives an OFF signal of the level switch 12 which is a level sensor installed at a side of external air pipe of a column of the electrode boiler chamber 2, controls the exhaust electronic valve 8 to be opened, and discharges steam to decrease the pressure and increase the water level in the electrode boiler chamber 2 so that a current within a normal range flows through the water in the electrode boiler chamber 2.

FIG. 4 is a flowchart illustrating a method of controlling the electrode boiler including intake and exhaust control valves and an electronic valve according to a first embodiment of the present invention. Referring to FIG. 4, the electronic control part 20 obtains a measured value of a current flowing through water in the electrode boiler chamber 2 (S11).

More specifically, the electronic control part 20 receives the measured value of the current flowing through the water in the electrode boiler chamber 2 from the CT 9 of the electrode boiler 100.

After operation S11, the electronic control part 20 determines whether the measured value of the current in operation S11 is greater than or equal to a preset critical current value (S12).

As a result of the determination in operation S12, in a case in which the measured value of the current is less than the preset critical current value, the electronic control part 20 returns to operation S11, and, on the contrary, in a case in which the measured value of the current is greater than or equal to the preset critical current value, the electronic control part 20 opens the intake electronic valve 5 (S13). That is, in the case in which the measured value of current is greater than or equal to the preset critical current value in operation S11, the electronic control part 20 transmits a relay contact signal to open the intake electronic valve 5.

After operation S13, the electronic control part 20 controls such that a water level in the electrode boiler chamber 2 is lowered due to a negative pressure (minus pressure) in the electrode boiler chamber 2 or air introduced thereinto (S14). More specifically, until the measured value of the current becomes less than the preset critical current value, the electronic control part 20 controls such that the negative pressure (minus pressure) in the electrode boiler chamber 2, which is caused by the hot water circulating pump 3 of the electrode boiler 100, is used, or externally provided compressed air is introduced into the electrode boiler chamber 2 by controlling the intake control valve 10 to lower a water level in the electrode boiler chamber 2 using the negative pressure (minus pressure) or the introduced air so that a contact area of the water in contact with the electrode bar 1 decreases, a current value returns to a normal range, and the electrode boiler 100 performs a function normally.

FIG. 5 is a flowchart illustrating a method of controlling an electrode boiler including intake and exhaust control valves and an electronic valve according to a second embodiment of the present invention. Referring to FIG. 5, the electronic control part 20 obtains a measured temperature value of water discharged from the electrode boiler chamber 1 (S21). That is, a case in which a water temperature measured by the temperature sensor 6 is within a preset high temperature range (for example, 100° C.±α) corresponds to a case in which a high current flows through water so that the water is boiled, and thus the electronic control part 20 determines that a water level is lowered through determining whether the temperature reaches the high temperature range by determining that the water level is lowered due to an increase in a pressure in the electrode boiler chamber 2 through the measured temperature value.

After operation S21, the electronic control part 20 determines whether the water temperature obtained in operation S21 reaches the preset high temperature range (S22).

As a result of operation S22, in a case in which the water temperature does not reach the preset high temperature range, the electronic control part 20 returns to operation S21, and, on the contrary, in a case in which the water temperature reaches the preset high temperature range, the electronic control part 20 waits for an OFF signal from the level switch 12 (S23).

After operation S23, the electronic control part 20 controls the exhaust electronic valve 8 to be opened or not opened according to receiving of the OFF signal from the level switch (S24).

After operation S24, in a case in which the water level in the electrode boiler chamber 2 is lowered according to an increase in a pressure, the electronic control part 20 stops controlling of the exhaust electronic valve 8 to be opened or not opened (S25).

That is, the electronic control part 20 receives the OFF signal from the level switch 12 which is the level sensor installed at the side of the external air pipe of the column of the electrode boiler chamber 2 and controls the exhaust electronic valve 8 to be opened so that steam is discharged, a pressure in the electrode boiler chamber 2 decreases, a water level increases, and thus a current within a normal range flows through the water in the electrode boiler chamber 2. Here, the electronic control part 20 receives a value of the water level in the electrode boiler chamber 2 from the water level detection sensor 2*a* and controls the exhaust electronic valve 8 to be opened until the lowered water level in operation S11 is restored.

The present invention may be implemented with codes which can be read by a computer in a recording medium through which the computer can read the codes. The recording medium which can be read by the computer includes any recording device in which data, which can be read by a computer system, is stored.

An example of the recording medium which can be read by the computer is a read-only memory (ROM), a random-access memory (RAM), a compact disc (CD)-ROM, a magnetic memory, a floppy disk, an optical data storage device, or the like, and the present invention may also be implemented using a carrier wave (for example, transmission through Internet).

In addition, the recording medium which can be read by the computer may be distributed in the computer system connected through a network, and the codes which can be read by the computer in a distribution method may be stored and executed. In addition, functional programs, codes, and code segments for implementing the present invention may be easily made by skilled programmers in the art.

As described above, while the specification and drawings describe exemplary embodiments of the invention and specific terms are used in the specification and drawings, these are used with general meanings to easily describe technological content of the invention and to aid in understanding of the invention, and the invention is not limited thereto. It is clear to those skilled in the art that various modifications based on the technological scope of the invention in addition to the embodiments disclosed herein can be made.

The invention claimed is:

1. An electrode boiler control apparatus including intake and exhaust control valves and an electronic valve which comprises an electronic control part (20) formed in an electrode boiler (100) in which an intake electronic valve (5) and an exhaust electronic valve (8) in addition to an intake control valve (10) and an exhaust control valve (11) corresponding to air control valves are formed at both sides of an upper portion of the electrode boiler (100) and including a control circuit (21) connected to the intake electronic valve (5) and the exhaust electronic valve (8) to control the intake electronic valve (5) and the exhaust electronic valve (8), a current controller (22) connected to a current transformer (CT, 9) connected between electrode bars (1) of the electrode boiler (100) to control the CT (9), and a temperature controller (23) connected to a temperature sensor (6) formed on a hot water tank (4) of the electrode boiler (100), and configured to control the temperature sensor (6) and receive a temperature value measured by the temperature sensor (6), wherein:

the intake control valve (10) is formed at a side of an external air pipe at which a level switch (12) is formed and formed as a valve configured to introduce external air into the electrode boiler chamber (2), wherein the intake electronic valve (5) is connected to a front end of the intake control valve (10), and when the intake electronic valve (5) is opened, a steam pressure generated due to heating of water in the electrode boiler chamber (2) is released;

the exhaust control valve (11) is formed at a side of an external air pipe which is disposed at one side of an upper portion of the electrode boiler chamber (2) and is in communication with the hot water tank (4), wherein the exhaust electronic valve (8) is connected to a front end of the exhaust control valve (11) in series, and when the exhaust electronic valve (5) is opened, the steam pressure is released to the hot water tank 4; and the control circuit (21) includes an intake control module (21*a*) configured to control such that, in a case in which a measured value of a current measured by the current transformer (9) and received through the current controller (22) is greater than or equal to a preset critical current value, a relay contact signal is transmitted to open the intake electronic valve (5), and when a negative pressure (minus pressure) in the electrode boiler chamber (2), which is generated by a hot water circulating pump (3) of the electrode boiler (100) is used or compressed air which is externally supplied is introduced into the electrode boiler chamber (2), a water level in the electrode boiler chamber (2) is lowered due to the negative pressure (minus pressure) or the introduced air to decrease a contact area of water in contact with the electrode bars (1) of the electrode boiler (100) so that a value of a current returns to a normal range, and an exhaust control module (21*b*) configured to control such that, since a case in which a water temperature measured by the temperature sensor (6) connected to the temperature controller (23) is within a preset high temperature range corresponds to a case in which a current flows through water so that the water is boiled, it is determined that a pressure in the electrode boiler chamber (2) increases to lower the water level, an OFF signal of the level switch (12), which is a level sensor installed at the side of the external air pipe of a column of the electrode boiler chamber (2), is received thereby, the exhaust electronic valve (8) is controlled to open to discharge steam, a pressure in the electrode boiler chamber (2) decreases, and a water level increases so that a current within a normal range, within which the water temperature in the electrode boiler chamber (2) does not reach the preset high temperature range, flows through the water.

* * * * *